FIG. 5 is a simplified block diagram of a system for controlling the apparatus of the present invention;

FIG. 6 is a perspective view of an array of printing needles generally of the type used in conjunction with the present invention;

FIG. 7*a* and 7*b* are bottom views of prior art needle printer arrays together with exemplary printed patterns;

FIG. 8 is a bottom view of a preferred needle printer array, in accordance with the present invention;

FIG. 9 is a top view of a slide having a cut-out side portion or notch;

FIG. 10 is a perspective view of a limit switch adapted to detect the presence of the notch on a moving slide;

FIG. 11 is a perspective view of a CRT display terminal for displaying stored data to be printed for possible editing of the data; and FIG. 12 is a block diagram showing the data storage and interface circuitry for operating the apparatus in an automatic print and display mode.

DETAILED DESCRIPTION OF THE PREFERRED EMBODIMENTS

In the apparatus shown in FIG. 1, a housing 2 is disposed on a table 1, and a guide track in the housing is disposed running horizontally (not visible in FIG. 1). At the beginning of the guide track, a supply magazine 3 is arranged in which slides, which are to be imprinted, can be disposed in the form of a stack. At the lower end of the supply magazine, there is a separating arrangement 4 permitting the slides stacked in the supply magazine 3 to be to be discharged individually and fed along the guide track. The slides are conveyed singly in the direction of the arrow A on the horizontally arranged guide track, and guided past a needle printer arrangement 5. The slides are imprinted there, and are conveyed further to the end of the guide track. From there, they are guided toward a receiving magazine 6 in the direction of the arrow B.

Before the receiving magazine 6, designated by reference numeral 7, a stacking arrangement has been provided, which has a slide mechanism controllable by way of an adjustable cam disk and which can be moved in a rhythm back and forth.

In the guide track 8, which is shown in the FIGS. 2 to 4, a driving arrangement 9 for the individual transportation of slides 10, is provided. The driving arrangement 9 has a continuous revolving conveying belt 11 with driver lugs 12. The arrangement of the driver lugs 12 is such that they always reach behind the slides 10 in a conveying direction. It is of no consequence for the operation of the apparatus whether or not openings 13 of the slides for the reception of diapositives (slides) contain such diapositives.

The conveying belt 11, which can also be developed as a chain, etc., is made to revolve continuously, guided by way of rolls 14 (one of the rolls 14 is shown in FIG. 3).

In the housing 2, a drive for the conveying belt 11 and also for the separating arrangement 4 includes an electromagnetic coupling for separating the conveying belt 11 from the driving arrangement. This serves the purpose of being able to operate the conveying belt 11 by way of a hand-operated wheel 16 (FIG. 1) for adjusting and/or experimenting, and the hand-operated wheel acts on the rotational axis of the guide roll 14.

In the area of the needle printer arrangement 5, an elastic guide arrangement 17 is arranged laterally in the guide track 8 at the level of the slides to be transported. The arrangement 17 is biased transversely to the direction of conveyance A with springs 18 for guiding slide 10 to be imprinted without interference in the area of the needle printer arrangement 5 in a horizontal direction.

In order to achieve guidance without interference in a vertical direction, a guide strip 19 (see FIG. 3) is located above the guide track 8. The guide strip 19 is vertically adjustable, and is mounted with corresponding apertures, on horizontal set pins attached firmly to the housing 2. Thus, the guide strip 19, because of its weight, fits from above against the slides to be imprinted and stops the latter in a vertical direction.

In the case of the embodiment shown in FIG. 2, the guide strip 19 is disposed above the conveying belt 11. In order to ensure that the driver lugs 12 should not be impeded in their movement, a recess 20, extending in a longitudinal direction, has been provided in the guide strip 19. Alternatively, however, the guide strip 19 may be arranged below the conveying belt 11, so that the movement of the driver lugs 12 is not impeded by the guide strip 19. Thus, in the embodiment of FIG. 2, recess 20 is not necessary.

The needle printer arrangement 5, described in more detail below, is fixed to the housing 2. The level of the needle printer arrangement 5 can be adjusted in the direction of the arrow C (FIG. 1) with an adjusting arrangement (not shown) to adapt printer 5 to slides of variable thickness.

The needle printer arrangement 5 has several needle printers, two of which are shown in FIG. 1 and are designated respectively by 5A and 5B. Each needle printer has a plurality of steel pins, which are disposed with their heads downward in a housing 21 formed conically downwardly tapering. Magnetic solenoid arrangements (not shown) are disposed around the shafts of the steel pins (not shown). The pins are driven forward with a control arrangement, and therefore can be moved downwardly toward the slide that is to be imprinted (see FIG. 4). The triggering takes place by way of a control arrangement 28 (FIG. 5) described in more detail below.

Referring to FIG. 6, a needle printer 5 of the type used in connection with the present invention is shown. Each printer 5 contains a plurality of needles 40 extending between an upper, control end 42 of printer 5 and a lower, contact end 44 of the printer. Although the needles 40 of conventional needle printers are typically positioned in a straight line parallel to the sides of the contact end 44*b*, as shown in FIGS. 6 and 7*b*, the needles have also been positioned diagonally, as shown on contact end 44*a* (FIG. 7*a*), in order to improve resolution. In accordance with the present invention, resolution of the printed characters is substantially improved using the array of needles as shown on contact end 44*c* (FIG. 8). The array on 44*c* is composed of first and second, parallel columns of needles, as shown. The second column of needles, identified by B, is positioned slightly to the right of the first column of needles, identified by A. The needles B are interposed between the needles A, and are oriented in and overlapping therewith, whereby a line perpendicular to the columns A and B will always pass through at least one needle. The needles in column B are preferably equispaced between corresponding needles in column A.

The needles in columns A and B of the contact end 44c in FIG. 8 are controlled in a time-shifted manner,

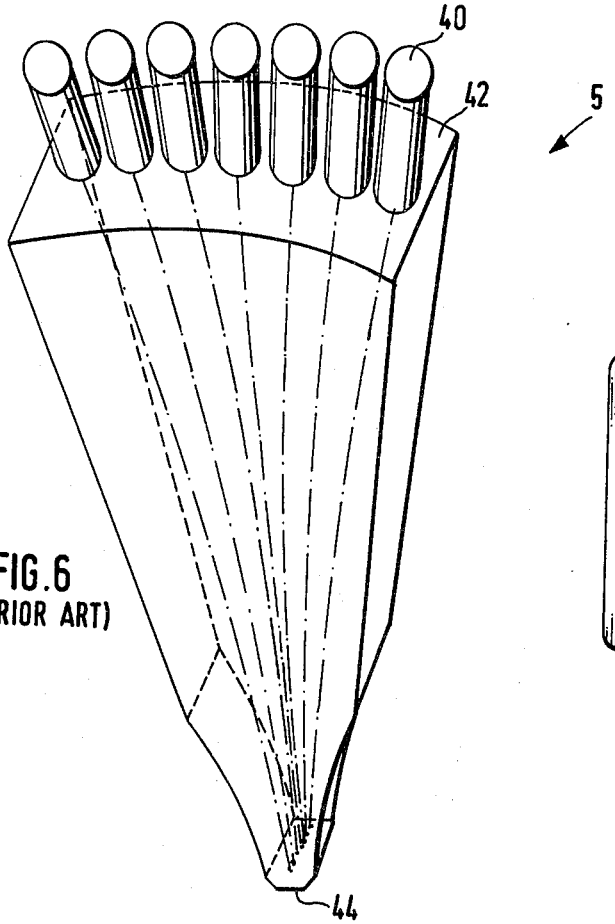
FIG.6
(PRIOR ART)
FIG.9
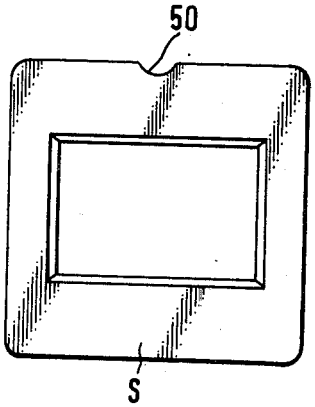
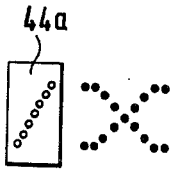
FIG.7a
(PRIOR ART)
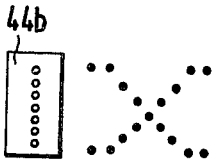
FIG.7b
(PRIOR ART)
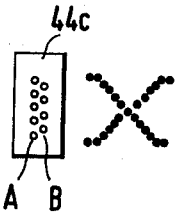
FIG.8

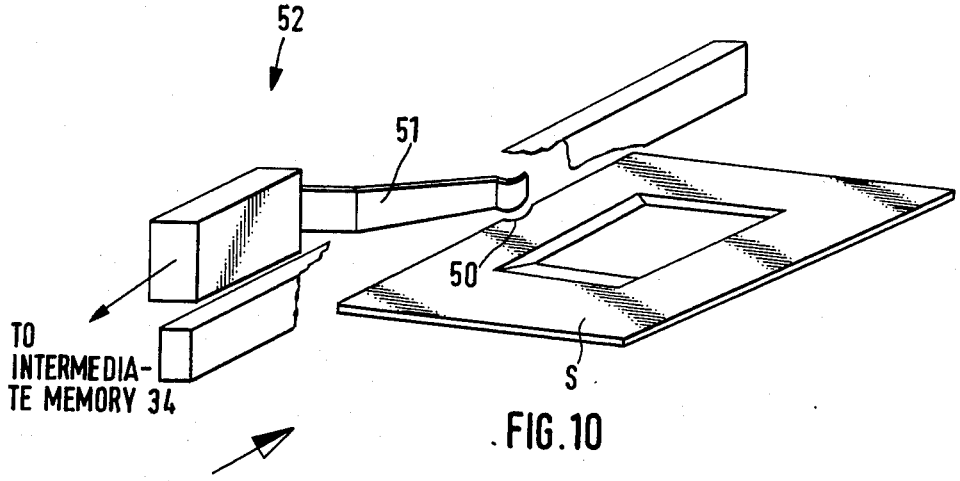
FIG.10
FIG.11
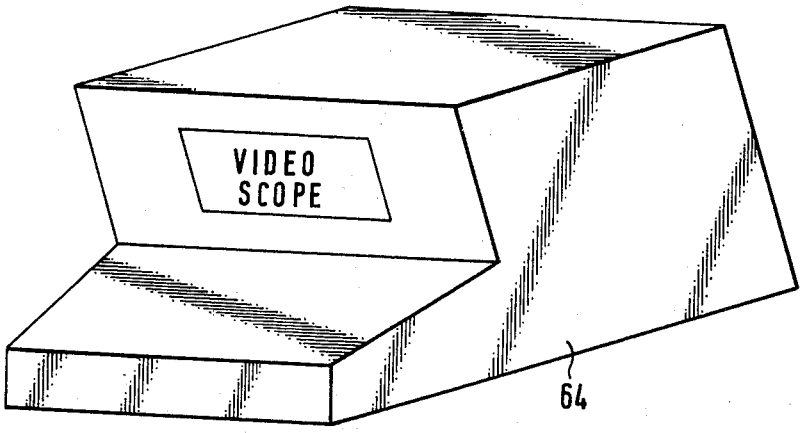
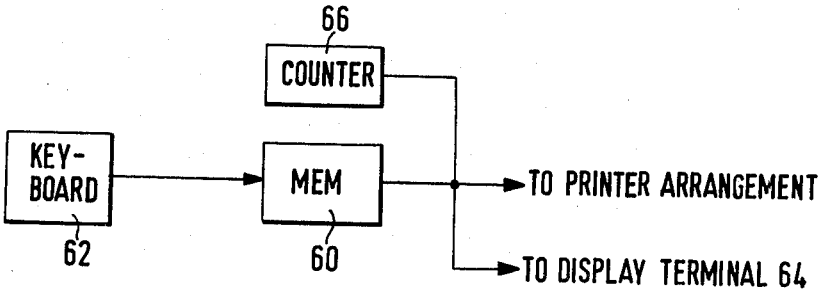
FIG.12

APPARATUS FOR PRINTING ON TRANSPARENCY SLIDES

CROSS REFERENCE TO RELATED APPLICATION

This application is a continuation-in-part of application Ser. No. 646,561, filed on Jan. 5, 1976, now abandoned.

FIELD OF THE INVENTION

This invention relates to an apparatus for printing or marking slides wherein the slides are fed individually to a printer and subsequently the slides are conveyed and then stacked.

BACKGROUND OF THE INVENTION

An inscription or marking on slides or film mounts is in many cases desirable in order to positively identify each slide. As an example, each slide may be provided with a number. This is very important to identify a sequence of slides that represents a series of photographic shots. For this purpose in the prior art, it has been known to first prepare a stereotype rubber plate of the desired inscription and then to apply a print of this stereotype rubber plate on the film mount. This prior art was basically the process of stamp printing with individual plates required for a sequence. This is expensive as to cost, and after printing, each slide needs to dry before stacking since the printing ink could otherwise smear. Any roughness in the surface of the mount has a disturbing influence causing the print to be irregular, even if the stereotype rubber plates are meticulously aligned before stamping. The present invention is based on the objective of avoiding these disadvantages.

A primary object of the invention, therefore, is to create an apparatus, by means of which a series of mounts can be numbered or otherwise lettered or inscribed without a plate in a simple manner by a continuous printing process.

BRIEF DESCRIPTION OF THE INVENTION

In order to solve this task according to the invention, provision has been made for the slides or film mounts to be moved individually past a needle printer arrangement having at least one needle printer where the printing process takes place during the movement of the mount past the needle printer arrangement. A needle printer assembly is provided having a multiplicity of steel pins, which is stationary in a transverse direction but can be selectively moved in a longitudinal direction in an array representing indicia by way of a magnetic control. Between the heads of the steel pins and the slide that is to be printed on, a colored ribbon arrangement saturated with solvents based on esters and keytones has been provided. Depending on which needles are triggered, different words, letters, and/or numbers are printed. The needles are preferably arranged in two parallel columns, with the needles in the second column being interposed between corresponding needles in the first row. The needles in the first and second columns overlap to provide a printed character having improved resolution. By "overlap" is meant that a line perpendicular to the two columns of needles can pass through a needle in each of the columns.

As a result of the fact that the slides that are to be marked are moved individually past a needle printing arrangement, and the printing process takes place during the movement of the slide past the needle printing arrangement, the desired printing can be accomplished in a simple, inexpensive manner and without any stereotype plate.

In an effective development according to the invention, provision is furthermore made for the mount to be moved under the laterally stationary needle printers during the printing process at a continuous speed. With this measure incorporated into the process, maximum speed plus a uniform printed character can be achieved. If the feed of the slides were varied, the width of the writing and the character of the writing might be changed, such as by smearing from the slide and the printer moving at different speeds at the instant of contact.

According to a further characteristic of the invention, provision can be made that during one movement of the slide past the needle printing arrangement several lines are inscribed. Thus, it is possible, for example in the case of commercial plastic amounts for 35 mm film, to dipose indicia above the picture aperture in three lines disposed one below the other, and the same number of inscribed lines below the picture frame, therefore, altogether giving six lines of printing. Since several lines can be inscribed during one passage of the slide past the needle printing arrangement, for example three lines can be inscribed during one passage, there is, compared to traditional single line writing heads, an effective increase of three times in the speed.

The apparatus provided more particularly is characterized in that a guide track for the conveyance of the slides has been provided. The driving arrangements for the transportation of the slides engage the slides along the edge outside the areas that are to be inscribed. The needle printing arrangement is operable by a control arrangement and projects into the area of the guiding track. The printer is attached in a locally fixed manner on the main frame of the apparatus. The needle printing arrangement has at least one printing head with a multiplicity of steel pins movable until they contact or fit against the slide moving past in the guide track. A color ribbon arrangement has been provided in front of the ends of the heads of the steel pins.

In a further feature of the invention, provision can be made for a supply magazine for sequential feeding of the slides. The magazine is provided at the beginning of the guide track, and at the end of the guide rack, a receiving magazine for the stack-like reception of the slides is provided. This arrangement makes it possible to simply insert slides that are to be printed in a stack, and withdraw them again as a stack into the supply magazine for any further imprinting of additional lines. Such a renewed insertion of the stack comes into question, for example, whenever any lettering is to be accomplished on the mounts in six lines. In the needle printer arrangement shown herein, there are only three needle printers that can thus imprint three lines at a time.

In a further development, an elastic or spring-loaded guiding arrangement has been provided making possible positive guiding of the slide in the area of the needle printer arrangement without lateral clearance. This maintains the slide steady in the area of the needle printer arrangement. In other words, this elastic guiding arrangement serves the purpose of guiding the slide during the imprinting process without clearance in the guide track, in order to gain, on the one hand, precise location of the printing, and on the other hand, a variable locating mechanism for different size slides.

The needle printing arrangement can have, according to the invention, several individual needle printers, such as three, as suggested above. The spatial location of the needle printers is such that the printing heads are disposed transversely to the direction of feeding and at intervals corresponding to the lines of inscription. In addition, several closely spaced needle printers may be disposed one behind the other stacked in relation to the longitudinal direction of conveyance.

In order to make possible a simple adaption of the apparatus to two slides of variable thicknesses, provision has been made according to a further characteristic of the invention, for the needle printer arrangement to be attached so as to be adjustable as to level vis-a-vis the guide track. The control arrangement, according to the invention, has a storage bank for fixed values for the fixed programming of the desired thicknesses.

For the purpose of triggering the needle printing arrangement, a programable storage bank has been provided. The indicia can be fed to the storage bank by way of a feeding-in or input arrangement including a typewriter keyboard. Because of an electronic or computer triggering of the needle printing arrangement, the latter can operate in such a way that in the case of one passage, a number of lines corresponding to the number of printers can be printed simultaneously. It is also possible, for example, in the case of one passage to inscribe the upper edge of a mount with several lines. Then the stack of slides, after being turned over or twisted by 180° is again inserted into the supply magazine and then the underside of the mount is imprinted with the same printing arrangement. The consequence of this normally would be that, because of the turning over, the last written characters would likewise be turned over and backward as compared to the first written characters and with respect to the film. In order to achieve the lettering running in the same direction of reading "on top" and "on the bottom" of the slides, an intermediate storage can be provided between the computer input mechanism and the keyboard, which would cause the characters to be fed into said input mechanism backward and upside down. As a result, the turning over of the slides is compensated.

The operation of the intermediate storage or memory may be automatically controlled using a switch or other sensor to detect a notch provided on only one edge of each slide. Thus, the switch causes the intermediate storage to be operative or non-operative depending upon detection of the presence or absence of a notch on the edge of each moving slide.

According to a further characteristic of the invention, provision can be made for a sequential numbering arrangement for the automatic and continuous numbering of the mounts. Such an arrangement can operate, for example, automatically without the need for each corresponding number to be fed manually into the inserting arrangement.

For an effective development of this characteristic of the invention, a provision can be made for the numbering arrangement to be operated by an electronic counting mechanism always moving by a shift register into the next sequential position. The numbering to be printed on each slide may be displayed in a CRT terminal so that editing changes may be entered prior to actual printing.

It is possible to change the width of the type and the character of the type by a change of the conveying speed of the slides past the fixed needle printing arrangement. In order to be able to carry out this change, the invention provides an adjusting arrangement for the adjustment of the conveying speed. This adjusting arrangement can, for example, have a potentiometer in the electric driving arrangement.

Finally, the invention provides that the input mechanism has an indicating arrangement for indicating the position of the lines, the reading of the lines and the number of characters per line. By the term "position of lines", there is to be understood an indication as to whether the adjustment of the needle printing arrangement is adjusted for "top" or "bottom" printing, that is to say, whether or not the intermediate storage, causing an inversion of the printed characters has been switched in. By "indication of the line", it is to be understood an indication is given as to which line is being presently printed, i.e., which of the altogether three lines. By the concept "number of characters per line", I mean the number of those characters which can be printed on one line. The indication arrangement which can be developed, for example, as a digital recording, will facilitate the operation of the arrangement according to the invention.

According to a further characteristic of the invention, provision can be made that above the guiding arrangement and outside of the areas of the slides that are to be printed on, a guide strip or rail has been provided at least in the area of the needle printer arrangement. This guide strip serves the purpose of preventing a slipping or shifting of the slide in a vertical direction during the imprinting.

An effective development of this feature requires the guide strip to fit by its own weight from above against the slide that is to be imprinted. The strip is secured by means of vertical fitting pins against any slippage. Naturally, the guide strip can be developed in such a way, that it will extend across almost the entire length of the upper film strip of the guide arrangement. Whenever the guide strip is disposed in the middle above the conveying arrangement, the guide strip effectively will have a continuous recess extending in a longitudinal direction in order not to impede the movement of the drivers. Naturally provision can also be made for the guide strip to be displaced transversely in relation to the longitudinal direction vis-a-vis the drivers, so that the recess is not necessary.

Further details and characteristics will develop from the succeeding description of an embodiment given by way of example and on the basis of the drawing.

BRIEF DESCRIPTION OF THE DRAWINGS

FIG. 6 is a perspective view of an array of printing needles generally of the type used in conjunction with the present invention;

FIG. 7*a* and 7*b* are bottom views of prior art needle printer arrays together with exemplary printed patterns;

FIG. 8 is a bottom view of a preferred needle printer array, in accordance with the present invention;

FIG. 9 is a top view of a slide having a cut-out side portion or notch;

FIG. 10 is a perspective view of a limit switch adapted to detect the presence of the notch on a moving slide;

FIG. 11 is a perspective view of a CRT display terminal for displaying stored data to be printed for possible editing of the data; and FIG. 12 is a block diagram showing the data storage and interface circuitry for operating the apparatus in an automatic print and display mode.

DETAILED DESCRIPTION OF THE PREFERRED EMBODIMENTS

Figure 1:
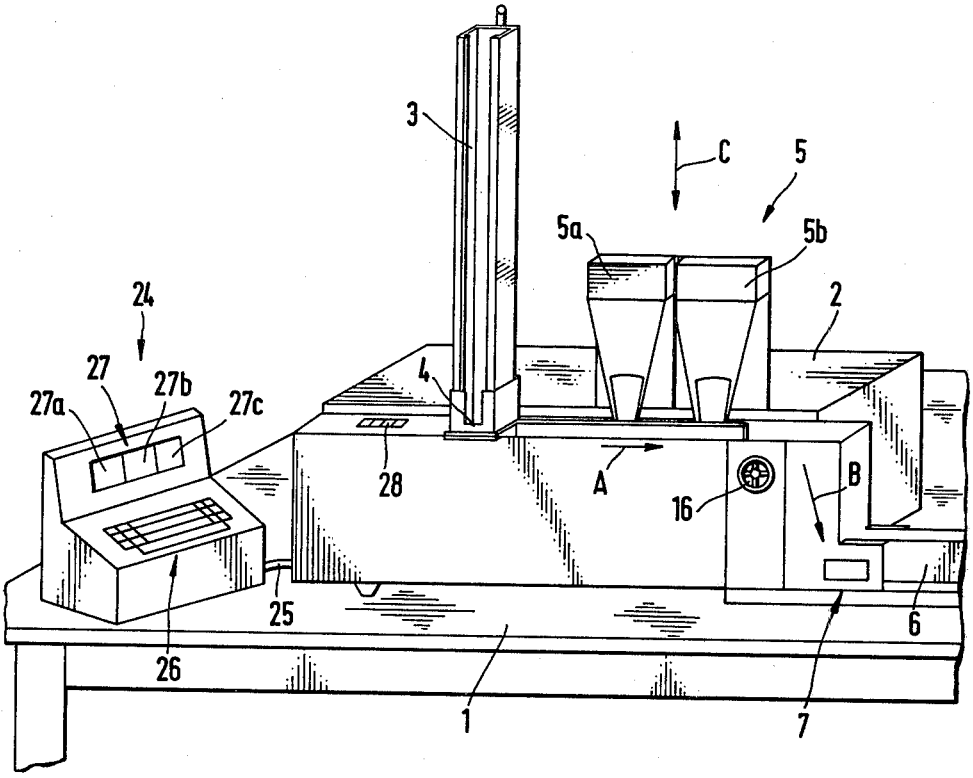
FIG. 1 is a schematic, perspective presentation of a preferred embodiment by way of example, for the apparatus for marking slides by lettering.

In the apparatus shown in FIG. 1, a housing 2 is disposed on a table 1, and a guide track in the housing is disposed running horizontally (not visible in FIG. 1). At the beginning of the guide track, a supply magazine 3 is arranged in which slides, which are to be imprinted, can be disposed in the form of a stack. At the lower end of the supply magazine, there is a separating arrangement 4 permitting the slides stacked in the supply magazine 3 to be to be discharged individually and fed along the guide track. The slides are conveyed singly in the direction of the arrow A on the horizontally arranged guide track, and guided past a needle printer arrangement 5. The slides are imprinted there, and are conveyed further to the end of the guide track. From there, they are guided toward a receiving magazine 6 in the direction of the arrow B.

Before the receiving magazine 6, designated by reference numeral 7, a stacking arrangement has been provided, which has a slide mechanism controllable by way of an adjustable cam disk and which can be moved in a rhythm back and forth.

Figure 2:
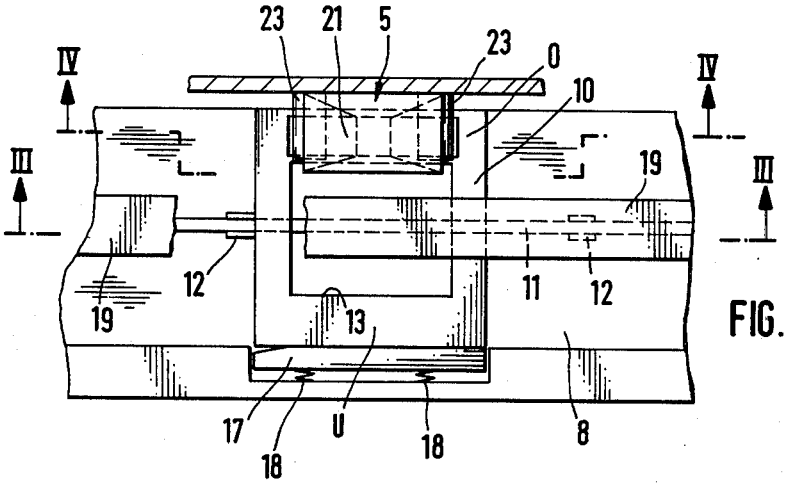
FIG. 2 is a detailed presentation in the form of a top view of the guide track in the area of the needle printer arrangement whereby merely one needle printer has been shown schematically.
Figure 3:
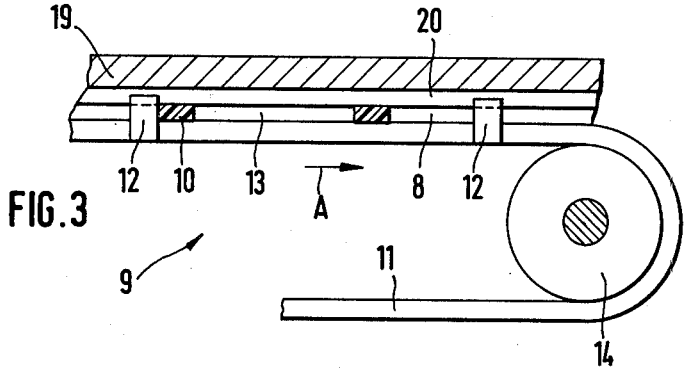
FIG. 3 is a cross-sectional presentation taken along line 3—3 in FIG. 2, whereby some parts have been omitted in order to achieve a clearer presentation.
Figure 4:
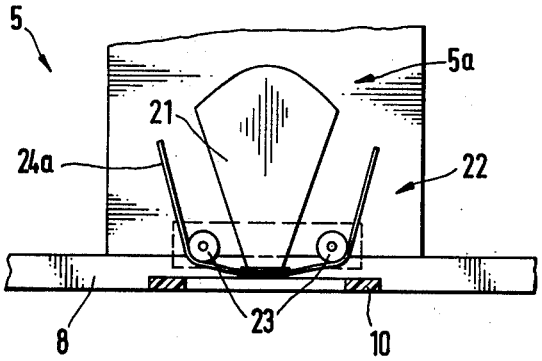
FIG. 4 is a cross-sectional presentation corresponding to the line 4—4 in FIG. 2, whereby parts have been omitted likewise for achieving a clearer presentation.

In the guide track 8, which is shown in the FIGS. 2 to 4, a driving arrangement 9 for the individual transportation of slides 10, is provided. The driving arrangement 9 has a continuous revolving conveying belt 11 with driver lugs 12. The arrangement of the driver lugs 12 is such that they always reach behind the slides 10 in a conveying direction. It is of no consequence for the operation of the apparatus whether or not openings 13 of the slides for the reception of diapositives (slides) contain such diapositives.

The conveying belt 11, which can also be developed as a chain, etc., is made to revolve continuously, guided by way of rolls 14 (one of the rolls 14 is shown in FIG. 3).

In the housing 2, a drive for the conveying belt 11 and also for the separating arrangement 4 includes an electromagnetic coupling for separating the conveying belt 11 from the driving arrangement. This serves the purpose of being able to operate the conveying belt 11 by way of a hand-operated wheel 16 (FIG. 1) for adjusting and/or experimenting, and the hand-operated wheel acts on the rotational axis of the guide roll 14.

In the area of the needle printer arrangement 5, an elastic guide arrangement 17 is arranged laterally in the guide track 8 at the level of the slides to be transported. The arrangement 17 is biased transversely to the direction of conveyance A with springs 18 for guiding slide 10 to be imprinted without interference in the area of the needle printer arrangement 5 in a horizontal direction.

In order to achieve guidance without interference in a vertical direction, a guide strip 19 (see FIG. 3) is located above the guide track 8. The guide strip 19 is vertically adjustable, and is mounted with corresponding apertures, on horizontal set pins attached firmly to the housing 2. Thus, the guide strip 19, because of its weight, fits from above against the slides to be imprinted and stops the latter in a vertical direction.

In the case of the embodiment shown in FIG. 2, the guide strip 19 is disposed above the conveying belt 11. In order to ensure that the driver lugs 12 should not be impeded in their movement, a recess 20, extending in a longitudinal direction, has been provided in the guide strip 19. Alternatively, however, the guide strip 19 may be arranged below the conveying belt 11, so that the movement of the driver lugs 12 is not impeded by the guide strip 19. Thus, in the embodiment of FIG. 2, recess 20 is not necessary.

The needle printer arrangement 5, described in more detail below, is fixed to the housing 2. The level of the needle printer arrangement 5 can be adjusted in the direction of the arrow C (FIG. 1) with an adjusting arrangement (not shown) to adapt printer 5 to slides of variable thickness.

The needle printer arrangement 5 has several needle printers, two of which are shown in FIG. 1 and are designated respectively by 5A and 5B. Each needle printer has a plurality of steel pins, which are disposed with their heads downward in a housing 21 formed conically downwardly tapering. Magnetic solenoid arrangements (not shown) are disposed around the shafts of the steel pins (not shown). The pins are driven forward with a control arrangement, and therefore can be moved downwardly toward the slide that is to be imprinted (see FIG. 4). The triggering takes place by way of a control arrangement 28 (FIG. 5) described in more detail below.

Referring to FIG. 6, a needle printer 5 of the type used in connection with the present invention is shown. Each printer 5 contains a plurality of needles 40 extending between an upper, control end 42 of printer 5 and a lower, contact end 44 of the printer. Although the needles 40 of conventional needle printers are typically positioned in a straight line parallel to the sides of the contact end 44*b*, as shown in FIGS. 6 and 7*b*, the needles have also been positioned diagonally, as shown on contact end 44*a* (FIG. 7*a*), in order to improve resolution. In accordance with the present invention, resolution of the printed characters is substantially improved using the array of needles as shown on contact end 44*c* (FIG. 8). The array on 44*c* is composed of first and second, parallel columns of needles, as shown. The second column of needles, identified by B, is positioned slightly to the right of the first column of needles, identified by A. The needles B are interposed between the needles A, and are oriented in and overlapping therewith, whereby a line perpendicular to the columns A and B will always pass through at least one needle. The needles in column B are preferably equispaced between corresponding needles in column A.

The needles in columns A and B of the contact end 44c in FIG. 8 are controlled in a time-shifted manner, that is, first the needles in column A are activated. As the slide to be lettered is advanced, the needles in column B are activated when those needles are located exactly over the points to be printed in a manner similar to that in U.S. Pat. No. 3,900,094 to Larsen et al. The result is a character having improved resolution, as shown by the letter "X" in FIG. 8. This is to be compared with the letters "X" in FIGS. 7*a* and 7*b* provided by the prior art needle arrays.

Between the heads of the steel pins and the slide 10, a color ribbon arrangement 22 (FIG. 4) includes a color ribbon 24*a* guided by way of guide rolls 23. The number of needles contained in the individual needle printers is basically arbitrary, but in practice, approximately from 7 to 9 needles are provided. Depending on which needles are triggered by way of the magnetic control arrangement, variable configurations of particular characters (letters) can be achieved, as well as variable letters. Since the individual characterizations are not fixed, as in a typewriter, but are composed of individual dots, the possibility of inscribing is not limited to Latin letters, but other types of writing, e.g., Arabic letters etc. can also be written.

The color ribbon 24*a* of a type shown in U.S. Pat. No. 3,970,183 to Robinson et al is preferably saturated with a plastic solubolizing solvent of a type based upon esters and keytones. As a result, when printing is to take place on slide frames formed of plastic, a firm connection is produced between the colors and the slide surface. This occurs since the plastic at the surface of the frame, at the moment of printing, is slightly dissolved and the color particles can penetrate into this dissolved layer. The result is lettering that dries rapidly and cannot be wiped off.

Figure 5:
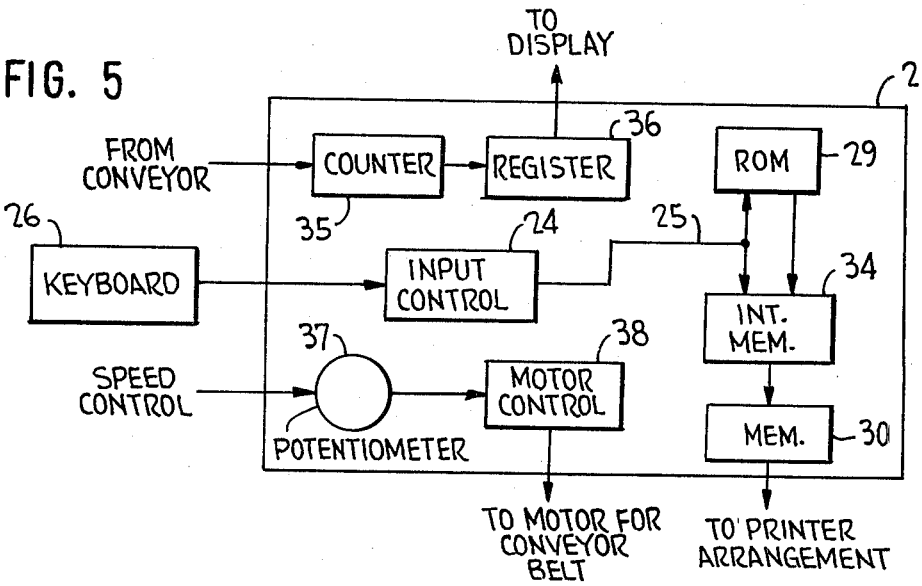
FIG. 5 is a simplified block diagram of a system for controlling the apparatus of the present invention.

Referring to FIG. 5, control arrangement 28 has a read-only memory 29 disposed in the housing 2, in which the desired characters (letters) are programmed. For the actual triggering a programmable memory 30 is also provided in the housing 2, into which the characters can be fed from the read only memory 29 by way of the input control 24 (see also FIG. 1). The input control 24 is connected to memories 29 and 30 in the housing 2, with an electric wire 25 and a conventional keyboard 26 for inputting typewriter characters.

The system of FIG. 1 may be operated in the manner described above using keyboard 26 to input characters to be printed, or may be programmed to print predetermined characters on successive slides. This may include successively numbered slides, or identical characters on predetermined numbers of slides. In either case, the characters to be printed are stored in a memory 60 (FIG. 12) that may be programmed by a keyboard 62 which may be a separate keyboard or may be the same keyboard as keyboard 26 in FIG. 5. The output of memory 60 is supplied to the printer arrangement, similarly to memory 30 in FIG. 5. The output of memory 60 may also be supplied to a CRT display terminal 64 for individual display of any or simultaneous display of all characters to be printed on successive slides. It can be appreciated that display 64 enables editing of character data prior to actual printing.

Memory 60 may be provided by conventional solid state or core memory units, or may be provided by magnetic tape for large volume storage.

A counter 66 may also be provided to supply successive characters, either alphabetical or numerical, to the printer arrangement and to display terminal 64. Counter 66 would require no programming and would be advantageous where successive numbering of slides without "looping" called for.

In operation, a slide 10 brought up on the guide track 8 is imprinted during the continuous passage underneath the needle printer arrangement. In the case of the arrangement shown in FIG. 2, one needle printer has been shown, so that in the case of one passage, naturally only one line can be printed.

As is clear from FIG. 1, during one passage it is also possible for several needle printers, such as needle printers 5A and 5B, to become operative, so that during one passage two lines can be lettered simultaneously.

Obviously it is also possible to provide still further needle printer arrangements. In such an arrangement, needle printers 5A and 5B are stacked transversely to the direction of conveyance A, to save space.

Whenever, as in the case of the embodiment shown, a needle printer arrangement 5 has been provided merely on one side of the guide track, then during one passage, one portion of the slide 10, designated by 0, can be imprinted with one or several lines. If it is desired that an opposite portion U also be imprinted, this can be accomplished in a simple manner since the stack of slides imprinted on the portion O is taken out of the receiving magazine 6 and is then again inserted into the supply magazine disposed by 180° compared to the first passage. Accordingly, portion U reaches the area of the needle printer 5 during the passage.

In order to achieve that the inscription, as compared to the inscription already existing on the portion 0, would not stand upside down, an intermediate memory 34 is connected between the input control 24 and the programmable memory 30 in the housing 2, the intermediate memory 34 is a first in - last out memory and passes on the characters fed into said memory backwards to the programmable memory. As a result, the inscriptions on the portion O and of the portion U are applied in the same reading direction. The intermediate memory 34 itself can likewise be developed as a programmable memory.

Referring to FIGS. 9 and 10, the operation of intermediate memory 34 may be controlled by a microswitch 52 (FIG. 10) having an operator 51 biased into sliding engagement with an edge of slide frame S. One edge of slide frame S has formed therein a cut-out portion 50 which is useful for stacking the slides with proper orientation. As a slide frame S on the conveyor passes switch 52, the switch operator 51 detects the orientation of the slide, that is, whether the slide has the orientation shown in FIG. 10 or has an opposite orientation (rotated 180°). Switch 52 activates the intermediate memory 34 only when slide frame S is in a predetermined orientation, e.g., as shown in FIG. 10, to control the printing of characters on the slide frame.

A numbering arrangement for the automatic continuous numbering of the slides has been provided, as shown in simplified form in FIG. 5. This arrangement has an electronic counter 35 of a type shown in U.S. Pat. No. 3,650,205 to Wybrow et al. having an output connected to a shift register 36 to store the accumulated counter output for display.

A change of the constant speed of the conveying belt 11 causes a change of the width of the printing and of the printing character. This can be achieved, e.g., with a potentiometer 37 for controlling a conventional drive motor control 38 (FIG. 5).

Beside the keyboard 26, the input control 24 has a digital recording arrangement 27 which always has separate picture windows (viewing windows) 27A, 27B and 27C. The viewing window 27 serves for the recording of the position of the line, therefore for the indication as to whether or not the feeding in takes place for the topside 0 or the underside U (FIG. 2). The viewing window 27B serves for the recording of lines, i.e., whether or not, e.g., the needle printer 5A is triggered for the first line or the needle printer 5B for the second line. The viewing window 27C displays how many symbols (characters) per line have already been fed in. The switches etc. required for the operation of the apparatus are disposed in a control console 28.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and descriptions are to be regarded as illustrative in nature, and not as restrictive.

What is claimed is:

1. An apparatus for printing characters on slides, comprising a guide track for transporting the slides; constant speed driver means engaging said slides outside of the areas thereof that are to be inscribed for transporting said slides; needle printer means projecting into the area of said guide track for contact printing on the slides, including a plurality of pins movable up to and fitting against the slide guided past in said guide track, said pins being constrained against lateral movement; control means for controlling said needle printer means; said control means including a read only memory for storing desired characters; and a programmable memory for storing characters fed thereto from the read only memory via a keyboard, said programmable memory triggering said needle printer means; and an intermediate memory connected between said control means and said programmable memory, said intermediate memory including a first-in, last-out memory device, said intermediate memory device storing characters from said read only memory fed to said intermediate memory by said control means, said intermediate memory further feeding said stored characters to said programmable memory backward and inverted as a result of the first-in, last-out storage of said characters.

2. The apparatus of claim 1, including means for detecting the orientation of a slide, and means responsive to said detection means for controlling said intermediate memory.

3. The apparatus of claim 2, wherein said sensing means includes a limit switch for detecting a characteristic of a moving slide on said guide track.

4. The apparatus of claim 3, wherein each of said slides includes a cut-out portion on one edge of the slide, and wherein said switch means includes an operator positioned adjacent said guide track and operative to detect the presence or absence of said cut-out portion of a moving slide.

* * * * *